US006692822B2

(12) United States Patent
Andersson et al.

(10) Patent No.: US 6,692,822 B2
(45) Date of Patent: Feb. 17, 2004

(54) COATED CEMENTED CARBIDE CUTTING TOOL INSERT

(75) Inventors: Gunilla Andersson, Solna (SE); Mikael Lindholm, Hägersten (SE)

(73) Assignee: Sandvik Aktiebolag, Sandviken (SE)

( * ) Notice: Subject to any disclaimer, the term of this patent is extended or adjusted under 35 U.S.C. 154(b) by 0 days.

(21) Appl. No.: 10/006,672

(22) Filed: Dec. 10, 2001

(65) Prior Publication Data

US 2002/0114981 A1 Aug. 22, 2002

(30) Foreign Application Priority Data

Dec. 19, 2000 (SE) ..... 0004695

(51) Int. Cl.[7] ..... B23B 27/14

(52) U.S. Cl. ..... 428/216; 51/307; 51/309; 428/336; 428/472; 428/697; 428/698; 428/699; 428/701; 428/702

(58) Field of Search ..... 428/698, 701, 428/702, 216, 336, 472, 469, 697, 699; 51/307, 309

(56) References Cited

U.S. PATENT DOCUMENTS

| | | | | |
|---|---|---|---|---|
| 4,277,283 | A | | 7/1981 | Tobioka et al. |
| 4,610,931 | A | | 9/1986 | Nemeth et al. |
| 4,830,930 | A | | 5/1989 | Taniguchi et al. |
| 4,859,542 | A | * | 8/1989 | Begg et al. |
| 4,913,877 | A | * | 4/1990 | Yohe |
| 5,106,674 | A | | 4/1992 | Okada et al. |
| 5,181,953 | A | * | 1/1993 | Nakano et al. |
| 5,296,016 | A | * | 3/1994 | Yoshimura et al. |
| 5,451,469 | A | | 9/1995 | Gustafson et al. |
| 5,484,468 | A | | 1/1996 | Östlund et al. |
| 5,549,980 | A | | 8/1996 | Ostlund et al. |
| 5,649,279 | A | | 7/1997 | Gustafson et al. |
| 5,729,823 | A | | 3/1998 | Gustafson et al. |
| 6,080,477 | A | * | 6/2000 | Narasimhan |
| 6,413,628 | B1 | * | 7/2002 | Narasimhan |

FOREIGN PATENT DOCUMENTS

| | | |
|---|---|---|
| EP | 0 560 212 A1 | 9/1993 |
| EP | 0 569 696 A2 | 11/1993 |
| EP | 1 043 415 A2 | 10/2000 |
| EP | 1 043 416 A2 | 10/2000 |
| WO | 93/17140 A1 | 9/1993 |
| WO | 97/15411 | 5/1997 |

* cited by examiner

*Primary Examiner*—Archene Turner
(74) *Attorney, Agent, or Firm*—Burns, Doane, Swecker & Mathis, LLP

(57) ABSTRACT

A cemented carbide has a <70 μm, preferably 10–40 μm, thick binder phase enriched surface zone containing W and Mo but depleted in cubic carbide. The overall content of Mo in the surface zone is the same as that in the inner portion of the cemented carbide. By alloying the cemented carbide with Mo, the performance has been improved particularly when used for turning at conditions causing intermittent thermal and mechanical load in stainless steel.

5 Claims, 3 Drawing Sheets

COATED CEMENTED CARBIDE CUTTING TOOL INSERT

This application claims priority under 35 U.S.C. §§119 and/or 365 to 0004695-3 filed in Sweden on Dec. 19, 2000; the entire content of which is hereby incorporated by reference.

FIELD OF THE INVENTION

The present invention relates to coated cemented carbide cutting tool insert. The cemented carbide insert is based on WC, cubic carbides and has a Co-binder phase enriched surface zone. By alloying the cemented carbide with Mo, the performance has been improved particularly when used for turning at conditions causing intermittent thermal and mechanical load in stainless steel.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

High performance cutting tools have nowadays to possess high wear resistance, high toughness properties and good resistance to plastic deformation. Improved resistance to plastic deformation of a cutting insert can be obtained by decreasing the WC grain size or by lowering the overall binder phase content, but such changes simultaneously result in significant loss in toughness properties.

Methods to improve the toughness behavior without loss in plastic deformation by so called gradient-sintering techniques are known. The gradient consists of thick essentially cubic carbide free and binder phase enriched surface zones (<50 μm) of the cemented carbide inserts e.g., through U.S. Pat. Nos. 4,277,283, 4,610,931, 4,830,930, 5,106,674 and 5,649,279. Such inserts with essentially cubic carbide free and binder phase enriched surface zones are extensively used today for machining of steel and stainless steel. These patents are examples of the importance of the substrate composition within the surface zone for cutting performance. The properties of the insert such as resistance to plastic deformation and toughness behavior have to be balanced for optimal performance during machining to ensure long and stable tool life.

There are also ways to balance the plastic deformation resistance and toughness properties to a certain extent by controlling the composition of the surface zone by employing special sintering techniques or alloying elements, e.g., U.S. Pat. Nos. 5,484,468, 5,549,980, 5,729,823 EP-A-560 212 or EP-A-569 696. The characteristics of all the above-mentioned patents are that the surface zones are essentially cubic carbide free and binder phase enriched, i.e., they consist of WC and Co. Such surfaces zones give the insert good edge toughness but makes the insert less sufficient when working conditions are causing thermal and mechanical load to the insert.

It is therefore an object of the present invention to provide a cemented carbide insert with improved properties for turning when the temperature and mechanical load is varying without losing resistance to plastic deformation and edge toughness.

SUMMARY OF THE INVENTION

A coated cutting tool insert has a cemented carbide substrate having a surface zone and an inner portion and a coating. The substrate comprises WC, 5–15 wt. % Co, 0.5–4 wt. % Mo, 1–10 wt. % cubic carbides, and a binder phase enriched surface zone essentially free of gamma phase and the surface zone has a Mo content 0.9–1.1 of that in the inner portion.

In one aspect, the WC has grains having a duplex structure made up of a core and a surrounding rim containing Mo.

In an additional aspect, the cobalt binder phase has a CW-ratio of 0.72–0.94, the CW-ratio expressed as CW-ratio=Ms/(wt. % Co×0.0161) where Ms is the measured saturation magnetization of the cemented carbide and the wt. % Co is the weight percentage of Co in the cemented carbide.

In a further aspect, the coating comprises <1 μm TiN, 1–5 μm MTCVD-TiCN, 1–3 μm κ-alumina, and <1 μm TiN.

In a still further aspect, the cubic carbides are selected from the group consisting of TiC, TaC and NbC.

BRIEF DESCRIPTION OF THE DRAWING FIGURES

The objects and advantages of the invention will become apparent from the following detailed description of preferred embodiments thereof in connection with the accompanying drawings in which like numerals designate like elements and in which.

DETAILED DESCRIPTION OF THE INVENTION

It has now been found that by adding Mo to cemented carbide inserts with binder phase enriched surface zones unexpected improvements when turning under intermittent thermal and mechanical conditions are obtained.

According to the present invention, there is now provided a cemented carbide with a <70 μm, preferably 10–40 μm, thick binder phase enriched surface zone containing W and Mo but depleted in cubic carbide. The content of Mo in the surface zone is 0.9–1.1 of that in the inner portion of the cemented carbide.

The present invention is applicable to cemented carbides with a composition of 5–15, preferably 7–11, weight percent (wt-%) binder phase comprising mainly Co (Fe and Ni only at impurity level), a total amount of 1–10, preferably 4–7, wt-% of cubic carbides such as TiC, TaC, NbC and the balance WC. In addition, the cemented carbide contains 0.5–4 wt-%, preferably 0.5–3 wt-%, most preferably 1–2 wt-% Mo. The average WC grain size is 0.5–4.0 μm, preferably 1–2 μm. The tungsten carbide grains have a duplex structure made up of a core and a surrounding rim. The content of Mo in the rim varies between roughly 2 and 25 wt-%, with the highest amount close to the core.

The cobalt binder phase is highly alloyed with W. The content of W in the binder phase can be expressed as the CW-ratio:

$$CW\text{-ratio}=\text{Ms}/(wt\text{-}\%Co\times 0.0161)$$

where Ms is the measured saturation magnetization of the cemented carbide and wt-% Co is the weight percentage of Co in the cemented carbide. The CW-ratio is a function of the W content in the Co binder phase. A low CW-ratio corresponds to a high W-content in the binder phase.

According to the invention improved cutting performance is achieved if the cemented carbide body has a CW-ratio of 0.72–0.94, preferably 0.76–0.90. The cemented carbide body may contain small amounts, <5 volume-%, of eta phase ($M_6C$), without any detrimental effect.

Cemented carbide inserts are produced by powder metallurgical methods including: milling of a powder mixture forming the hard constituents and the binder phase including a small amount of N, drying, pressing and sintering under vacuum in order to obtain the desired binder phase enrichment. Mo is added as $Mo_2C$.

Cemented carbide inserts according to the invention are preferably coated with a thin wear resistant coating with CVD-, MTCVD or PVD-technique. Preferably, the coating consists of <1 μm TiN, 1–5 μm MTCVD-TiCN, 1–3 μm κ-alumina and <1 μm TiN.

EXAMPLE 1

Figure 1:
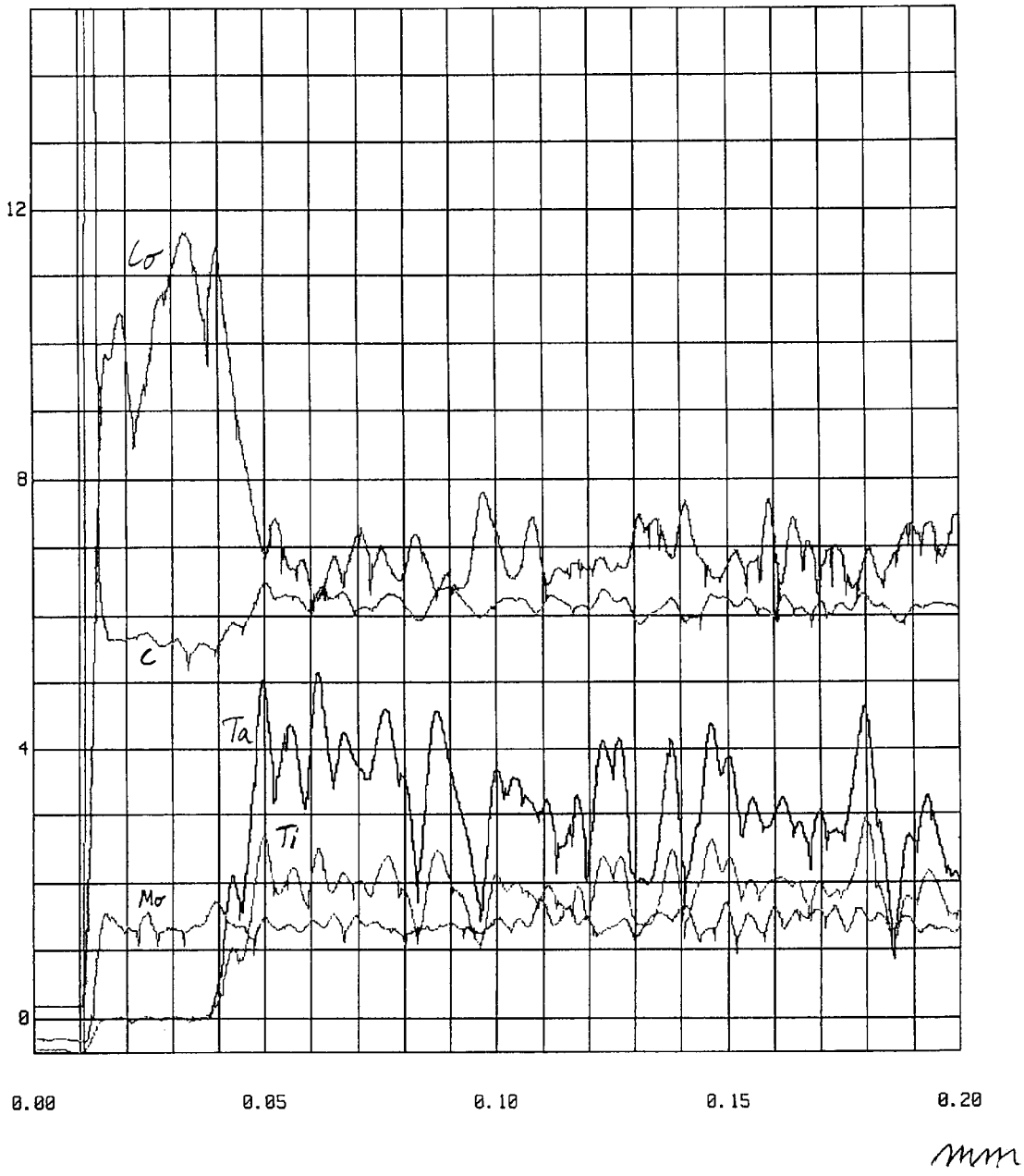
FIG. 1 shows the distribution of Ti, Ta, Co, C and Mo in the surface zone of a cemented carbide insert according to the invention.
Figure 2:
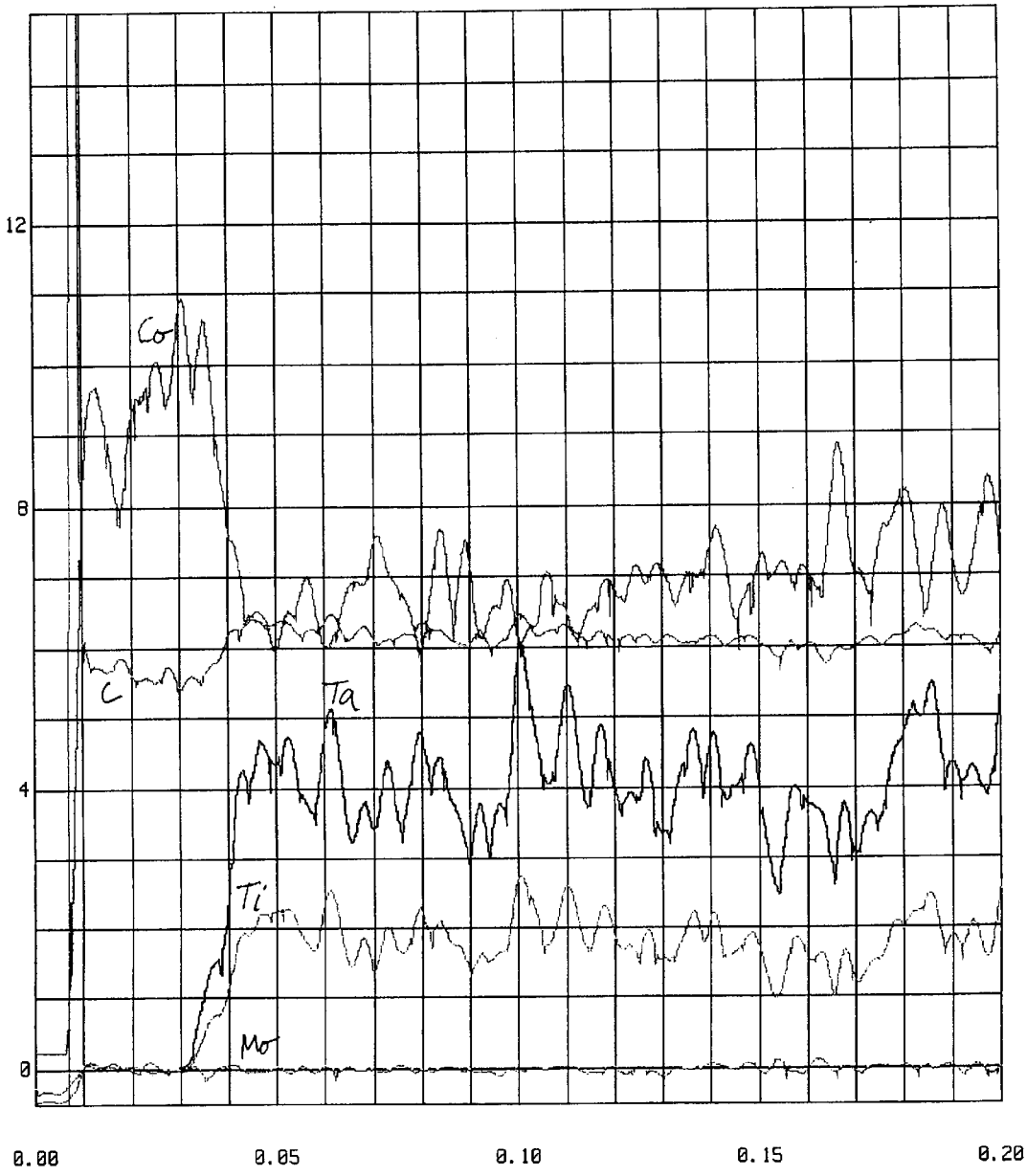
FIG. 2 shows the distribution of Ti, Ta, Co, C and Mo in the surface zone of a cemented carbide insert according to prior art.
Figure 3:
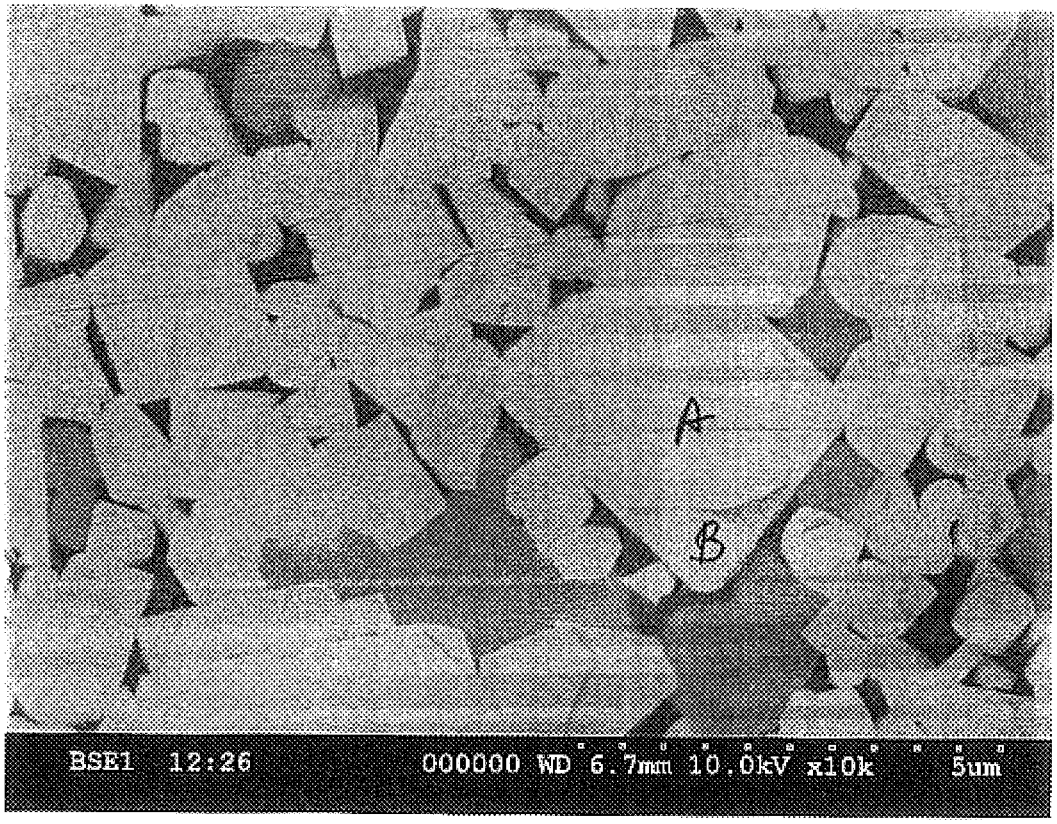
FIG. 3 shows the microstructure of a cemented carbide insert according to the present invention where A is the W-core and B is the W+Mo rim.

A.) Cemented carbide tool inserts of the type CNMG 120408-MM, an insert for turning, with the composition 7.5 wt-% Co, 3.8 wt-% TaC, 1.9 wt-% TiC, 0.4 wt-% TiN, 0.4 wt-% $Mo_2C$ and the balance WC with an average grain size of 1.7 μm and a CW-ratio of 0.86 were produced by powder metallurgical methods. The powder metallurgical methods include milling of a powder mixture forming the hard constituents and the binder phase, pressing and sintering. The pressed bodies were sintered at 1450° C. according to standard practice. The sintered blanks achieved a cubic carbide free zone reaching roughly 25 μm into the substrate from the surface, FIG. 1. The tungsten carbide phase of the produced inserts consisted of duplex structure made up of a core and a surrounding rim, FIG. 3. The content of Mo in the rim varied between roughly 2 and 25 wt-%, with the highest amount close to the core. After conventional precoating treatment like edge honing, cleaning etc. the inserts were coated in a CVD-process giving a 0.4 μm TiN, 2 μm moderate temperature TiCN, 2 μm κ-alumina and 0.8 μm TiN.

B.) Cemented carbide tool insert of the type CNMG 120408-MM with the composition 7.5 wt-% Co, 3.8 wt-% TaC, 1.9 wt-% TiC and 0.4 wt-% TiN and the balance WC with an average grain size of 1.7 μm and a CW-ratio of 0.87 were produced. The inserts were subject to sintering, precoating treatment and coating to achieve the same physical properties as A. The sintered blanks achieved a cubic carbide free zone reaching roughly 25 μm into the substrate from the surface. The tungsten carbide phase of the produced inserts had no rim and core structure.

C.) Cemented carbide tool inserts of the type CNMG 120408-MM, an insert for turning, with the composition 9.9 wt-% Co, 3.0 wt-% TaC, 2.5 wt-% TiC, 0.3 wt-% TiN, 0.4 wt-% $Mo_2C$ and balance WC with an average grain size of 1.7 μm and a CW-ratio of 0.78 were produced by powder metallurgical methods. The powder metallurgical methods include milling of a powder mixture forming the hard constituents and the binder phase, pressing and sintering. The pressed bodies were sintered at 1450° C. according to standard practice. The sintered blank achieved a cubic carbide free zone reaching roughly 20 μm into the substrate from the surface. Metallographic investigation showed that the hard constituents of the produced inserts consist of duplex structures made up of a core and a surrounding rim. After conventional precoating treatment like edge honing, cleaning etc. the inserts were, in a CVD-process giving a 4 μm moderate temperature TiCN, 1.5 μm κ-alumina, 0.5 μm TiN coating. TiN was after that removed on the edgelines by brushing.

D.) Cemented carbide tool insert of the type CNMG 120408-MM with the composition 10.0 wt-% Co, 6.0 wt-% TaC, 2.6 wt-% TiC and 0.4 wt-% TiN and the balance WC with an average grain size of 2.0 μm and a CW-ratio of 0.81 were produced. The inserts were subjected to the same sintering, pre-coating treatment, coating and edgeline brushing as C. The sintered blank achieved a cubic carbide free zone reaching roughly 20 μm into the substrate from the surface. The tungsten carbide phase of the produced inserts had no rim and core structure.

EXAMPLE 2

Insert variants from A and B were tested with respect to edge toughness behaviour when used for turning in stainless steel, AISI316Ti.

| Cutting data: | |
|---|---|
| Cutting speed = | 110 m/min |
| Feed = | 0.3 mm/rev. |
| Depth of cut = | 2.0 mm |

When the maximum wear exceeded 0.3 mm, the test was stopped.

| Results: | cycles |
|---|---|
| Insert A | 5 |
| Insert B | 3 |

EXAMPLE 3

Inserts from A to B were tested with respect to resistance to plastic deformation when used for turning in stainless steel, AISI304L.

| Cutting data: | |
|---|---|
| Cutting speed = | 250 m/min |
| Feed = | 0.3 mm/rev. |
| Depth of cut = | 2.0 mm |

The plastic deformation was measured as flank wear and the test was stopped when reaching 0.3 mm wear.

| Results: | cycles |
|---|---|
| Insert A | 13 |
| Insert B | 15 |

EXAMPLE 4

Inserts from A to B were tested in turning with respect to intermittent thermal and mechanical load in stainless steel, SS2343.

| Cutting data: | |
|---|---|
| Cutting speed = | 190 m/min |
| Feed = | 0.3 mm/rev. |
| Depth of cut = | 2.0 mm |

When the maximum wear exceeded 0.3 mm, the test was stopped.

| Results: | cycles |
|---|---|
| Insert A | 5 |
| Insert B | 2 |

EXAMPLE 5

Inserts from C to D were tested with respect to resistance to plastic deformation when used for turning in stainless steel, AISI304L.

| Cutting data: | |
|---|---|
| Cutting speed = | 200 m/min |
| Feed = | 0.3 mm/rev. |
| Depth of cut = | 2.0 mm |

The plastic deformation was measured as flank wear and the test was stopped when reaching 0.3 mm wear.

| Results: | cycles |
|---|---|
| Insert C | 13 |
| Insert D | 14 |

EXAMPLE 6

Inserts from C to D were tested in turning with respect to intermittent thermal and mechanical load in stainless steel, SS2343.

| Cutting data: | |
|---|---|
| Cutting speed = | 190 m/min |
| Feed = | 0.3 mm/rev. |
| Depth of cut = | 2.0 mm |

When the maximum wear exceeded 0.3 mm, the test was stopped.

| Results: | cycles |
|---|---|
| Insert C | 8 |
| Insert D | 4 |

While the present invention has been described by reference to the above-mentioned embodiments, certain modifications and variations will be evident to those of ordinary skill in the art. Therefore, the present invention is to limited only by the scope and spirit of the appended claims.

What is claimed is:

1. A coated cutting tool insert, comprising:

a cemented carbide substrate having a binder phase enriched surface zone and an inner portion, and a coating, the substrate comprises WC, 5–15 wt. % Co, 0.5–4 wt. % Mo, 1–10 wt. % cubic carbides, the binder phase enriched surface zone is essentially free of gamma phase, and the binder phase enriched surface zone has a Mo content 0.9–1.1 times that in the inner portion.

2. The coated cutting tool insert of claim 1, wherein the WC has grains having a duplex structure made up of a core and a surrounding rim containing Mo.

3. The coated cutting tool insert of claim 1, wherein the binder phase has a CW-ratio of 0.72–0.94, the CW-ratio= Ms/(wt. % Co×0.0161), where Ms is the measured saturation magnetization of the cemented carbide and the wt. % Co is the weight percentage of Co in the cemented carbide.

4. The coated cutting tool insert of claim 1, wherein the coating comprises <1 μm TiN, 1–5 μm MTCVD-TiCN, 1–3 μm κ-alumina, and <1 μm TiN.

5. The coated cutting tool insert of claim 1, wherein the cubic carbides are selected from the group consisting of TiC, TaC and NbC.

* * * * *